US007510485B2

(12) United States Patent
Yamamoto

(10) Patent No.: US 7,510,485 B2
(45) Date of Patent: Mar. 31, 2009

(54) GOLF CLUB HEAD

(75) Inventor: Akio Yamamoto, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 243 days.

(21) Appl. No.: 11/090,196

(22) Filed: Mar. 28, 2005

(65) Prior Publication Data

US 2005/0261082 A1 Nov. 24, 2005

(30) Foreign Application Priority Data

May 21, 2004 (JP) ..... 2004-152170

(51) Int. Cl.
*A63B 53/04* (2006.01)

(52) U.S. Cl. ..... 473/345; 473/348; 473/350

(58) Field of Classification Search ..... 473/324–350
See application file for complete search history.

(56) References Cited

U.S. PATENT DOCUMENTS 7,074,136 B2 * 7/2006 Noguchi et al. ..... 473/346
7,108,612 B2 * 9/2006 Nakahara et al. ..... 473/329
7,108,614 B2 * 9/2006 Lo ..... 473/345

FOREIGN PATENT DOCUMENTS

JP 2004159794 A * 6/2004

* cited by examiner

*Primary Examiner*—Gene Kim
*Assistant Examiner*—Alvin A. Hunter, Jr.
(74) *Attorney, Agent, or Firm*—Birch, Stewart, Kolasch & Birch, LLP

(57) ABSTRACT

A golf club head comprises a main body and a crown cover disposed in a crown portion of the head, wherein the main body comprises a crown base made of a metal material and provided with a plurality of openings gradually decreasing in the opening area from the backside to the foreside of the head, and the crown cover is made of a material such as FRP whose specific gravity is lower than the metal material, and disposed on the crown base so as to cover the openings.

11 Claims, 9 Drawing Sheets

GOLF CLUB HEAD

BACKGROUND OF THE INVENTION

The present invention relates to a golf club head, more particularly to a structure of the crown portion being capable of achieving a low center of gravity and a high restitution coefficient.

In the Japanese patent application publication Nos.2003-205055 and 2003-250935, as shown in FIG. 14 as "Ref.2", a golf club head comprising a main body whose top is opened as illustrated in dotted line, and a crown plate made of a fiber reinforced resin closing the top opening, has been proposed. As the almost entirety of the crown portion of the head is made of the fiber reinforced resin, the kinetic energy which the head receives from a golf ball at impact is consumed in the fiber reinforced resin in the crown portion. In other words, it is difficult to decrease an energy loss at impact close to zero. As a result, there is a limit to the improvement in the rebound performance of such head. Further, as the vibrations of the crown portion are quickly damped, the reverberating time becomes short, and further, the frequency of the hitting sound becomes low in comparison with all metal head. Therefore, such a golf club head is not always good for many golfers in hit feeling.

SUMMARY OF THE INVENTION

An object of the present invention is therefore, to provide a golf club head having a crown portion which can improve the rebound performance and lower the center of gravity to increase a traveling distance of a ball.

Another object of the present invention is to provide a wood-type hollow golf club head being capable of generating a favorable hitting sound having a relatively high frequency and a relatively long reverberating time.

According to the present invention, a golf club head comprises a main body and a crown cover disposed in a crown portion of the head, wherein the main body comprises a crown base made of a metal material and provided with a plurality of openings, the openings gradually decreasing in the opening area from the backside to the foreside of the head, and the crown cover is made of a material having a specific gravity lower than the metal material, and disposed on the crown base so as to cover the openings.

DESCRIPTION OF THE PREFERRED EMBODIMENTS

Figure 1:
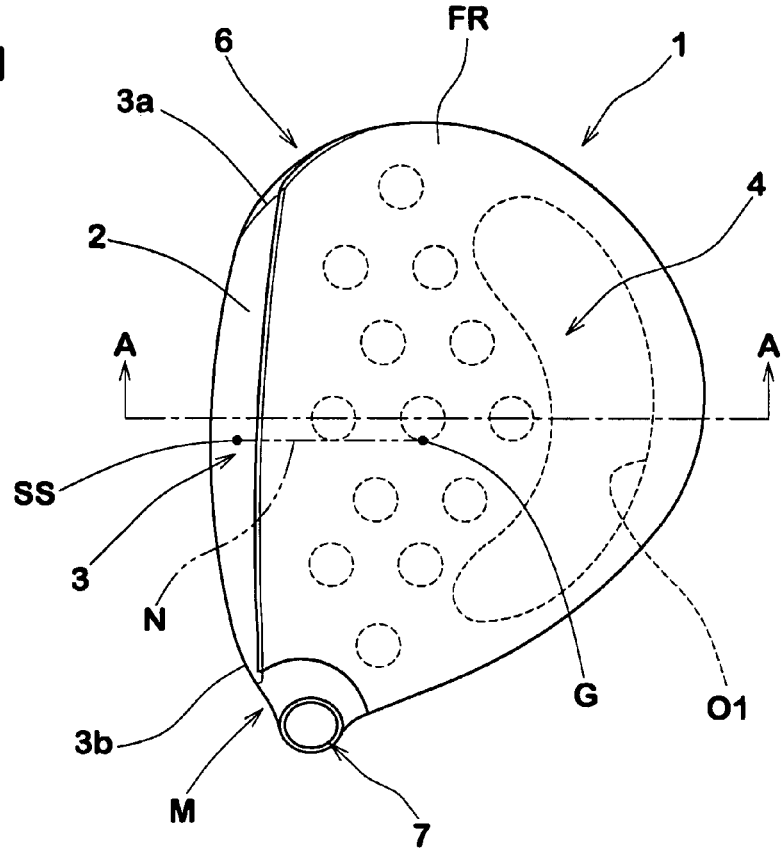
FIG. 1 is a top view of a wood-type golf club head according to the present invention.

Embodiments of the present invention will now be described in detail in conjunction with the accompanying drawings.

In the drawings, club head 1 according to the present invention is a wood-type hollow head such as driver (#1) and fairway wood.

The head 1 comprises a face portion 3 whose front face defines a club face 2 for striking a ball, a crown portion 4 defining a top face of the clubhead and intersecting the club face 2 at the upper edge thereof, a sole portion 5 defining a bottom face of the clubhead or sole and intersecting the club face 2 at the lower edge thereof, a side portion 6 between the crown portion 4 and sole portion 5 which extends from a toe-side edge to a heel-side edge of the club face 2 through the back face of the club head, and a neck portion 7 to be attached to an end of a club shaft (not shown), whereby a closed cavity (i) is formed.

The volume of the head is preferably set in the range of not less than 300 cc, more preferably more than 400 cc, still more preferably more than 420 cc, but not more than 500 cc. The upper limit is however, 470 cc if comply with the rules of the R&A or USGA.

The moment of inertia around a vertical axis passing through the center of gravity of the head is preferably set in the range not less than 2000 g sq. cm, more preferably not less than 3000 g sq. cm, still more preferably not less than 3500 g sq.cm under the following measuring state.

The moment of inertia around a horizontal axis extending in the toe-heel direction passing through the center of gravity is preferably set in the range of not less than 1500 g sq.cm, more preferably not less than 2000 g sq.cm, under the measuring state.

Here, the measuring state is that the club head 1 is set on a horizontal plane HP while keeping its lie angle and loft angle (Real loft).

The undermentioned back and forth direction of the head is a direction which is parallel with the horizontal plane HP and also when viewed from the top of the head as shown in FIG. 1, parallel with a straight line N drawn perpendicularly to the clubface 2 from the center G of gravity of the head.

The undermentioned toe-heel direction is a direction which is parallel with the horizontal plane HP and also when viewed from the top of the head as shown in FIG. 1, perpendicular to the straight line N.

The sweet spot SS is the intersecting point of the straight line N with the clubface 2.

The sweet spot height is the height from the horizontal plane HP to the sweet spot SS measured vertically under the measuring state.

Figure 3:
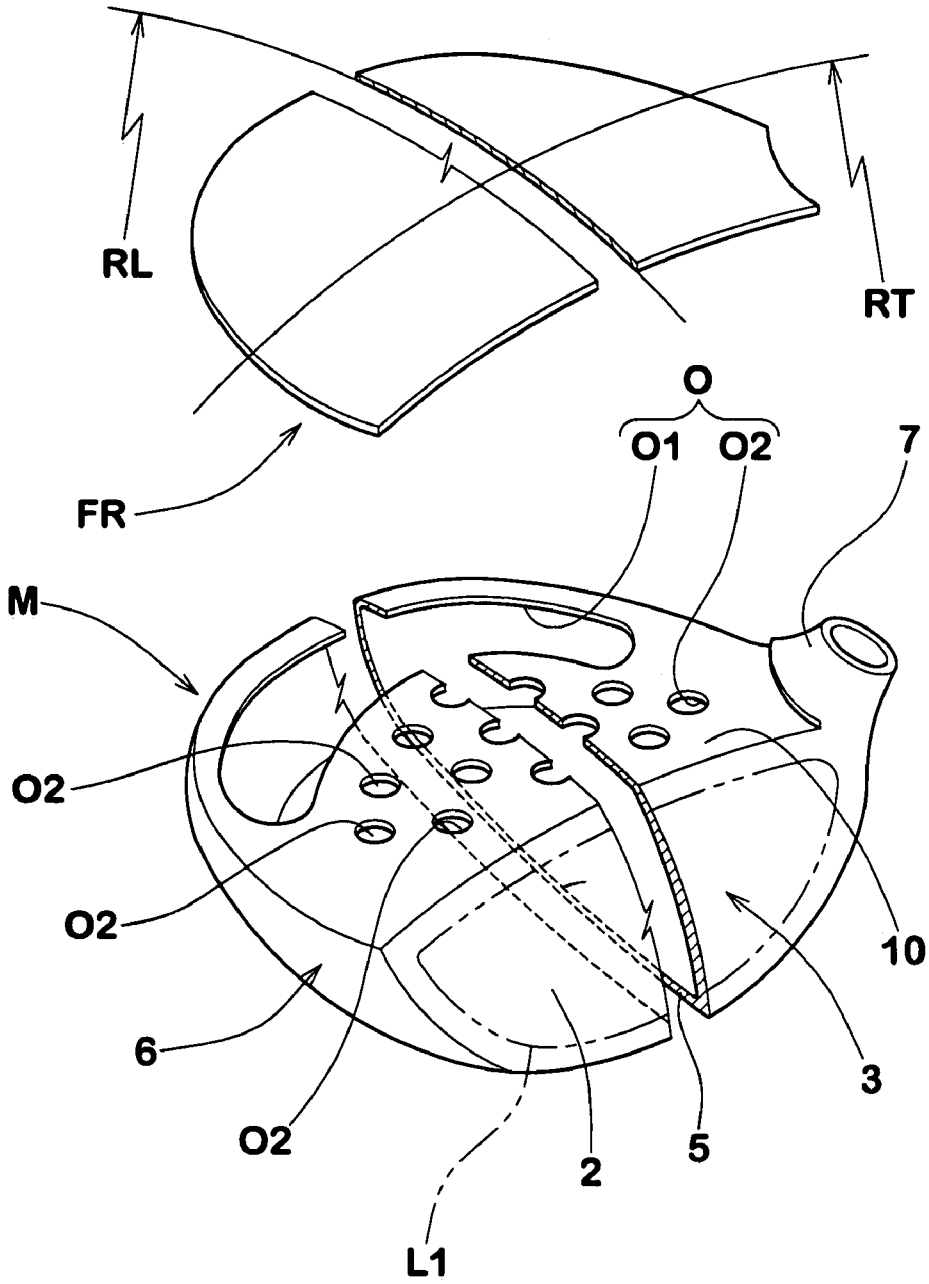
FIG. 3 is an exploded perspective view thereof showing a main body and a crown cover.

The head 1 comprises a main body M and a crown cover FR disposed in the crown portion 4, as shown in FIG. 3.

The main body M is made of at least one kind of metal material.

In order to make the main body M, various methods, e.g. forging, casting, press working, rolling and the like can be used. More specifically, the main body M can be made by assembling (or welding together) two or more metal parts each manufactured by a stable method. Further, the main body M can be formed as one body through casting or the like.

In the following embodiments, the main body M is a casting of one kind of metal material. Thus, the above-mentioned face portion 3, sole portion 5, side portion 6 and neck portion 7 and further a crown base 10 are integrally formed as one body.

The crown base 10 is provided with a plurality of openings O and forms a base of the crown portion 4, in other words, the crown base 10 forms the crown portion together with the crown cover FR.

As to the materials of the main body M, titanium alloys, pure titanium, maraging steels, stainless steels, aluminum alloys, magnesium alloys, amorphous alloys and the like can be used alone or in combination. In this embodiment, a titanium alloy Ti-6Al-4V having a specific gravity of about 4.4 or 4.5 is used.

The thickness tc of the crown base 10 is preferably set in the range of not less than 0.4 mm, more preferably more than 0.6 mm, but not more than 1.0 mm, more preferably less than 0.8 mm.

The crown base 10 forms the upper surface of the main body M provided with a plurality of openings O.

As the crown base 10 is covered with the crown cover FR to close all the openings O and form the top surface of the head, as shown in FIG. 3, the outer surface of the crown base 10 is provided with a dent of which depth and shape correspond to the thickness and shape of the crown cover, for example, near the neck portion 7, a step is formed. Therefore, the outer surface of the crown cover becomes flush with the surrounding portion of the main body.

The above-mentioned openings O include a first opening O1 and second openings O2. The first opening O1 is disposed near the rear end of the club head. The second openings O2 are each smaller in area than the first openings O1 and disposed on the front side of the first opening O1. In all the embodiments, the first opening O1 is the only one largest opening.

The percentage of the area S1 of the first opening O1 to the overall area Sc of the crown portion is set in the range of not less than 45%, preferably more than 50%, more preferably more than 55%, but not more than 75%, preferably less than 70%, more preferably less than 65%.

Figure 4:
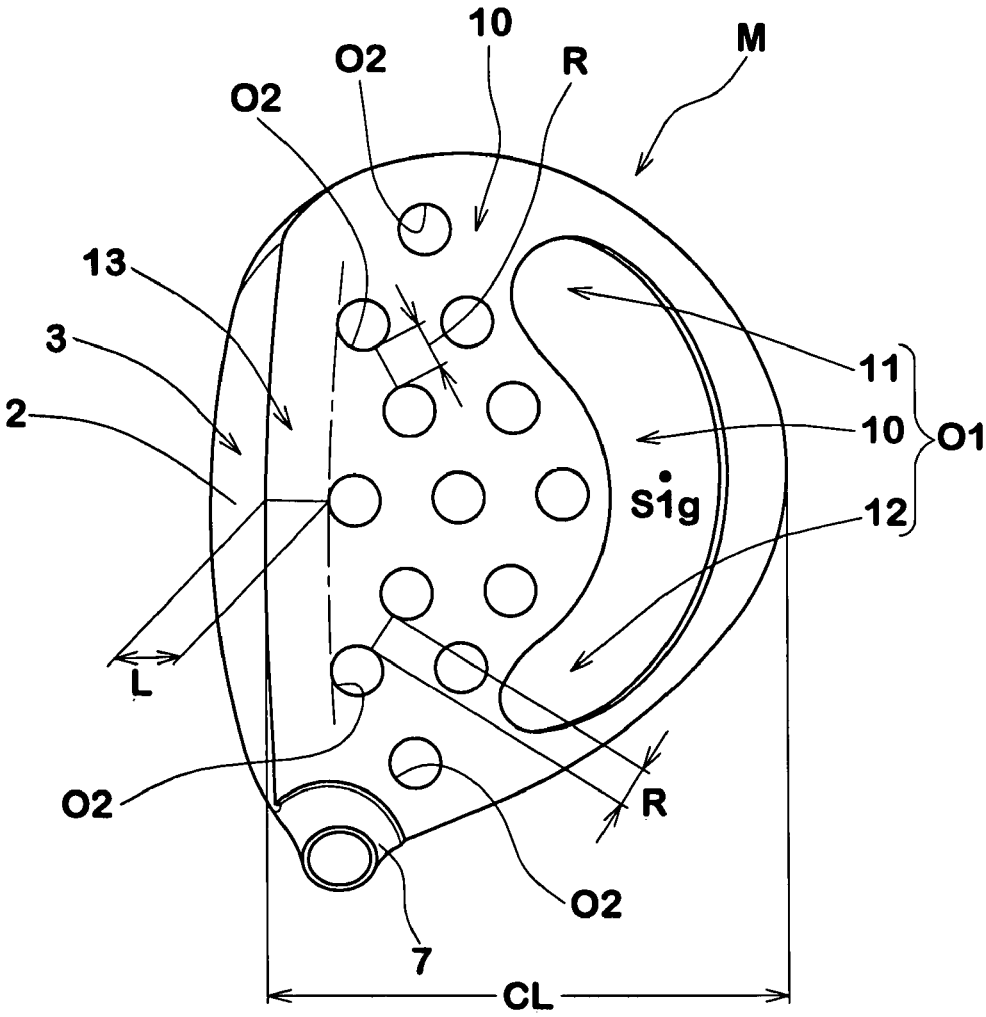
FIG. 4 is a top view of the main body showing a crown base.
Figure 13:
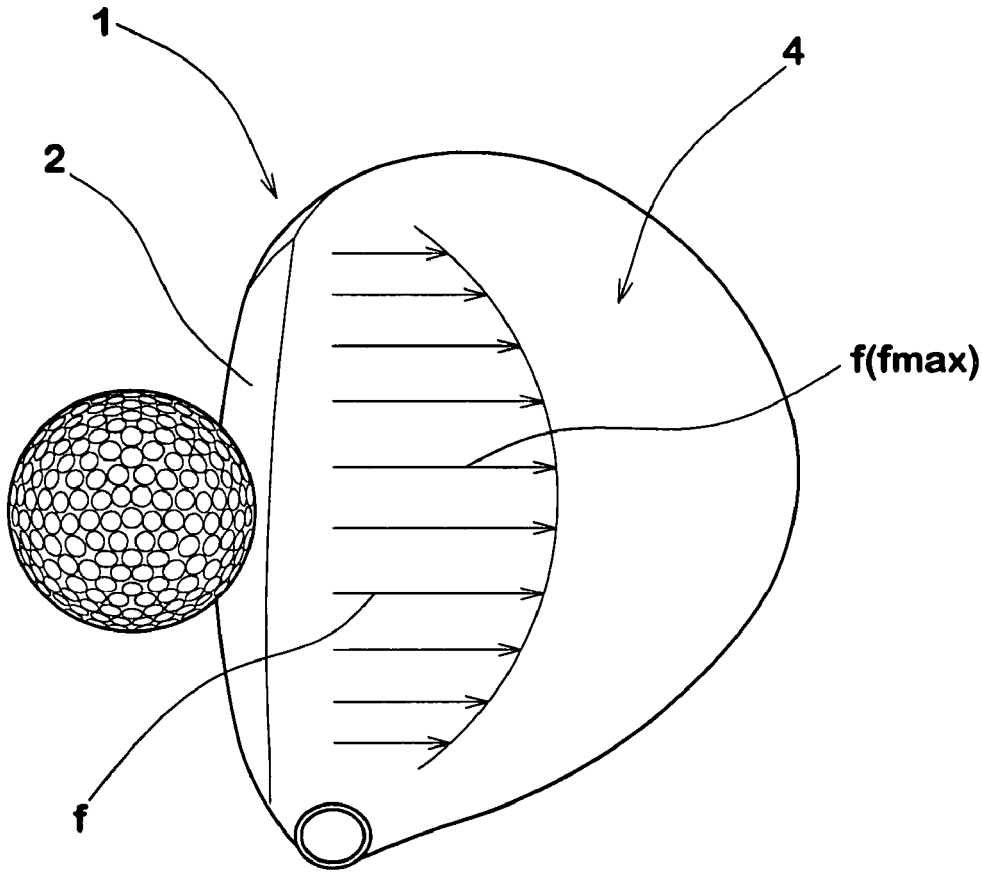
FIG. 13 is a diagram for explaining a typical distribution of an impact force.

In case of a wood-type club head having a typical size of about 300 cc, the opening area S1 of the first opening O1 is preferably set in the range of not less than 20 sq. cm, more preferably more than 21 sq. cm, still more preferably more than 22 sq. cm, but not more than 30 sq. cm, more preferably less than 28 sq. cm, still more preferably less than 26 sq.cm when viewed from above the head as shown in FIG. 4. Namely, the opening area S1 is defined as the area of the first opening O1 projected on the horizontal plane HP under the standard state of the club head 1. Further, the overall area Sc of the crown portion is defined as the area encircled by the contour line of the head projected on the horizontal plane HP.

when viewed from the top of the head, as shown in FIG. 4, the first opening O1 has a C-shape like a circle transformed by being elongated in the toe-heel direction and then curved backward.

when the face portion of a club head receives an impulsive force (f) from the struck ball, as shown in FIG. 13, in the crown portion, the distribution of the impulsive force (f) usually becomes a maximum (fmax) in the central part and gradually decreases towards the toe and heel. Like that, by making the first opening O1 of the C-shape, the opening area can be maximized while maintaining the necessary rigidity.

For that purpose, when viewed from the top of the head under the measuring state, the centroid S1*g* of the first opening O1 is positioned on the backside of a specific position in the back and forth direction of the head, which position is at a distance of 66% of the depth CL of the crown portion from the front end of the crown portion. In the FIG. 4 example, the toe-side part 11 and heel-side part 12 of the first opening O1 are extended to almost the midpoint of the depth CL, namely, about 50+/−10% of the depth CL.

The above-mentioned second openings O2 are formed in a part on the clubface side of the first opening O1. In this part, the stress caused by the impulsive force is relatively large. If a large opening like the first opening O1 is formed in this part, as the rigidity of the crown portion decreases, the strain at impact of the crown cover FR increases and its internal energy loss increases. Therefore, in order to provide a suitable rigidity, a plurality of openings O2 are formed, and the minimum distance R from each of the openings O2 to another opening (O2 or O1) is set in the range of not less than 4.0 mm, preferably more than 5.0 mm, more preferably more than 6.0 mm. If the minimum distance R is less than 4.0 mm, as the strength decreases, the amount of deformation increases, and the durability decreases. As to the upper limit, on the other hand, the minimum distance R is limited to not more than 10.0 mm, preferably less than 9.0 mm, more preferably less than 8.0 mm in order to form a suitable number of openings to obtain a stable rigidity distribution and a weight reduction.

when viewed from the top of the head, the centroids of the second openings O2 are located on the clubface side of the centroid of the first opening O1, and there is no opening whose centroid is positioned on the rear side of the centroid of the first opening O1.

The opening area S2 of each of the second openings O2 is set in the range of not less than 0.5 sq. cm, preferably more than 0.6 sq. cm, more preferably more than 0.7 sq. cm, but not more than 2.0 sq. cm, preferably less than 1.5 sq. cm, more preferably less than 1.0 sq. cm.

The number of the second openings O2 is in the range of not less than 10, preferably not less than 11, more preferably not less than 12, but not more than 20, preferably not more than 18, more preferably not more than 16.

The ratio (S2*a*/S1) of the total S2*a* of the opening areas S2 (sq. cm) of the second openings to the opening area S1 (sq. cm) of the first opening O1 is preferably set in the range of not less than 0.3, preferably more than 0.4, more preferably more than 0.5, but not more than 1.0, preferably less than 0.8, more preferably less than 0.7.

Figure 5:
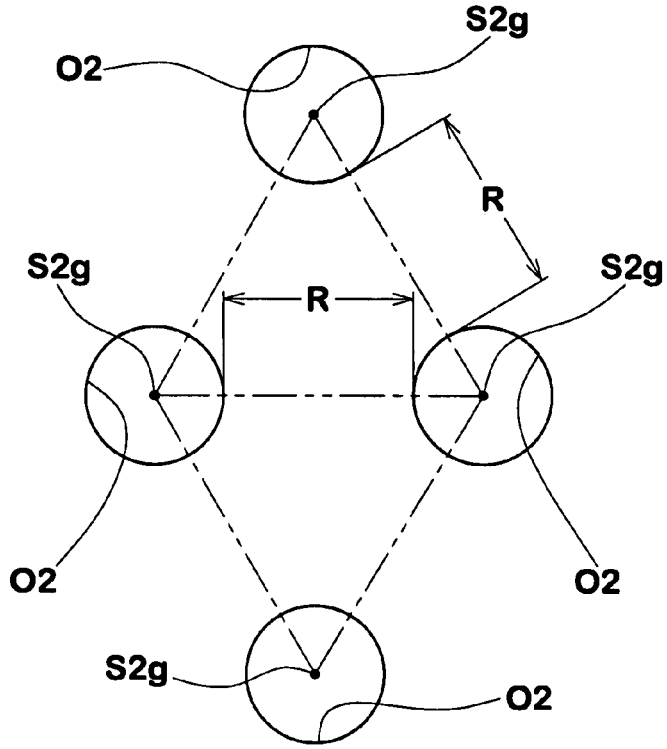
FIG. 5 is a diagram for explaining an arrangement of the second openings.

In the embodiments, the second openings O2 are arranged in a regular-triangular arrangement as shown in FIG. 5, wherein the distances R2 between the adjacent centroids S2*g* are the substantially same values. Aside form such regular-triangular arrangement, regular polygons can be employed in arranging the centroids S2*g*. Also another arrangement may be employed. In the embodiments, the second openings O2 are arranged in a plurality of rows extending in the toe-heel direction, and the number of the second openings O2 in each row increases from the backmost row to a row near the foremost row and then the number decreases to the foremost row. In the examples shown in FIGS. 4 and 6-8, the numbers are 1, 2, 3, 4(max) and 3 from the backmost row to the foremost row.

If the second openings O2 are arranged in a single row extending in the toe-heel direction or alternatively a single row extending in the back and forth direction of the head, it is difficult to achieve an improvement in the rebound performance as well as an effect weight reduction.

In FIGS. 3-6, the shape of the second opening O2 is a circle, but, it is also possible to employ round shapes and various polygons, e.g. ellipse, oval, square (FIG. 7), rectangle, hexagon (FIG. 8) etc. In FIG. 7, the second openings O2 are square. In FIG. 8, the second openings O2 are regular hexagon and arranged like a honeycomb. In case of polygons, the corners are rounded by a radius of at least 1.0 mm to avoid stress concentration.

Figure 6:
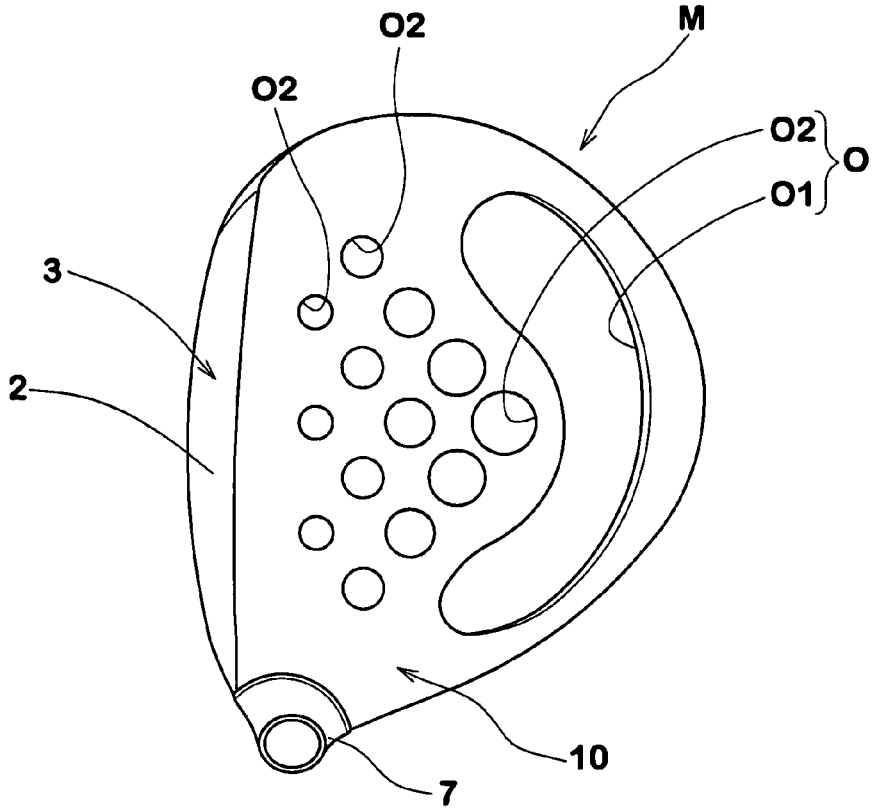
FIGS. 6, 7 and 8 are top views of the main body showing other examples of the arrangement of the openings.
Figure 7:
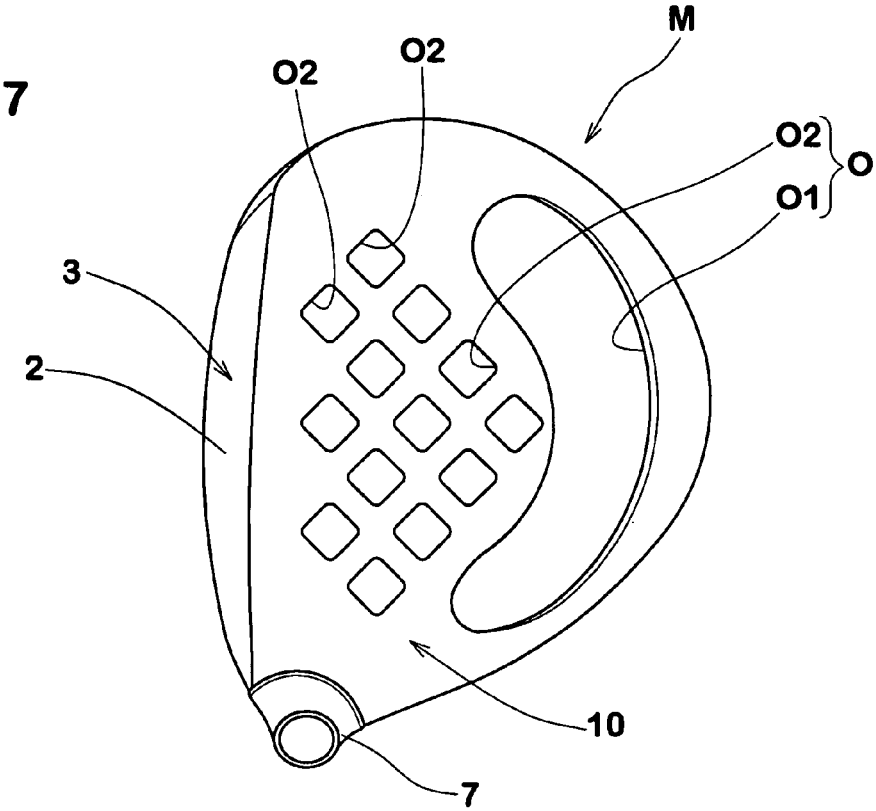
Figure 8:
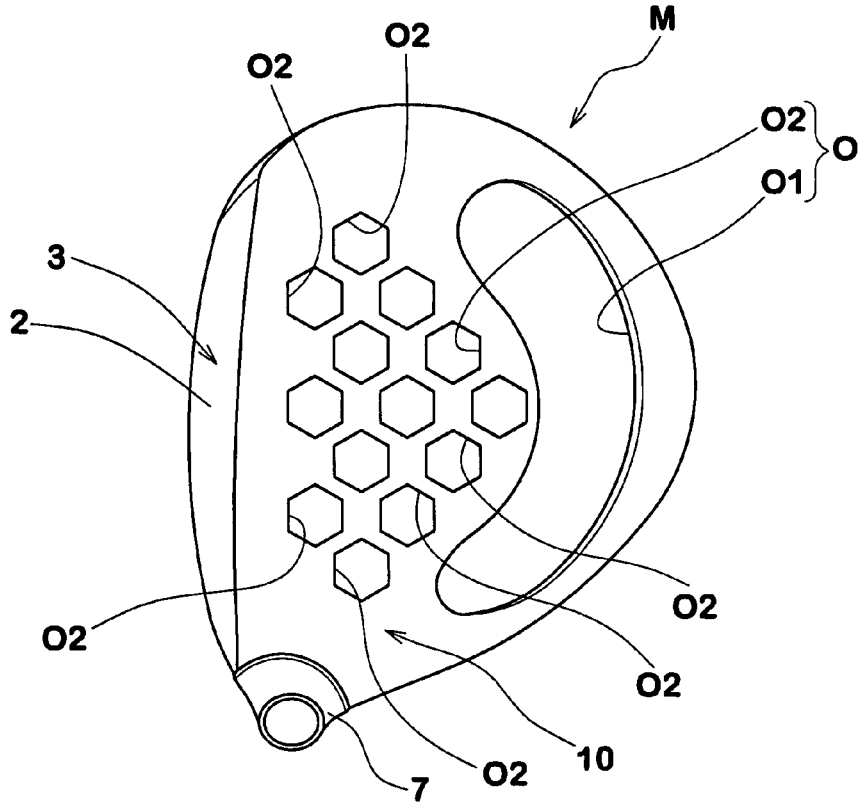

In the embodiments shown in the drawings, all the second openings O2 have one kind of shapes, namely, in FIGS. 4 and 6, all are circle, in FIG. 7, all are square, and in FIG. 8, all are hexagon. However, two or more different shapes can be used in a head. In case of one kind of shape, the size can be varied, for example, as shown in FIG. 6, wherein the size or diameter of the second opening O2 is gradually decreased from the back to the front of the head.

In all the embodiments in which the second openings O2 are in a triangular arrangement, even if the sizes are varied, the distances between the centroids S2*g* are substantially same values. Accordingly, in FIGS. 4, 7 and 8, as the second openings O2 are the same size, the above-mentioned minimum distances R become substantially same values.

In any case, it is preferable that, as shown in FIG. 4, a front end zone 13 of the crown portion is not provided with any opening and further, all the peripheral zone is not provided with any opening.

The front end zone 13 extends along the front edge of the crown portion (or crown base 10 in this example) from the toe to heel in the widthwise direction. And in the depthwise direction, it extends from the front edge towards the rear edge and the depth L thereof is set in the range of not less than 8 mm, preferably more than 10 mm, more preferably more than 12 mm for the durability, but in view of weight reduction, it is set in the range of not more than 25 mm, preferably less than 20 mm, more preferably less than 15 mm.

The crown cover FR is as shown in FIG. 3, a thin plate which covers the substantially overall area of the crown portion 4 excepting the neck 7. The crown cover FR is curved convexly and the radius of curvature RL in the back and forth direction is smaller than the radius of curvature RT in the toe-heel direction.

The crown cover FR is made of a material having a specific gravity less than that of the crown base 10. In this embodiment, a fiber reinforced resin is used.

As to the resin, for example, epoxide resin, unsaturated polyester resin, vinylester resin, phenol resin, nylon resin, polycarbonate resin and the like can be used.

As to the fiber, for example, organic fibers, inorganic fibers, and metal fibers, such as carbon fiber, glass fiber, aramid fiber, polyphenylene benzoxazole resin fiber (PBO fiber), amorphous metal fiber titanium fiber and the like can be used. The tensile elastic modulus thereof is set in the range of not less than 50 GPa, preferably more than 100 GPa, more preferably more than 150 GPa, still more preferably more than 200 GPa in view of rigidity and durability, but, in view of cost and tensile strength, it is preferably set in the range of not more than 450 GPa, more preferably less than 350 GPa, still more preferably less than 300 GPa. The tensile elastic modulus was measured according to japanese Industrial standard R7601: 1986, "Testing method for carbon fibers".

In the embodiments, the crown cover FR is made from an epoxide resin and carbon fibers. The resultant fiber reinforced resin has a specific gravity of about 1.3 to 1.5.

As far as the specific gravity is smaller than the above-mentioned metal material, various materials, for example, ebonite, nylon resin, ionomer resin, polycarbonate resin, polyethylene terephthalate (PET) resin, acrylonitrile-butadiene-styrene (ABS) resin, and the like which are not reinforced with fiber, and further even a metal material such as magnesium alloy, aluminum alloy and titanium alloy, may be used aside from a fiber reinforced resin.

In case of a fiber reinforced resin, it is preferable that the fibers form layers or plies, and in each ply, the fibers are oriented in one direction or two directions.

In order to manufacture such crown cover FR, various methods may be employed. But, in the embodiments, the crown cover FR is formed by laying prepreg sheets one upon another and then curing the layered structure in a mold by applying heat and pressure into a specified shape unidirectional prepreg and woven prepreg can be used. Preferably, at least one woven prepreg is included. Especially, it is preferable that the prepreg forming the outermost fiber layer is a square-woven prepreg, whereby the outermost fibers can be prevented from being disturbed by an external force during assembling and curing the crown cover. Further, the surface of fine texture can be easily obtained when unidirectional prepreg is used, usually it is arranged crosswise to an adjacent unidirectional prepreg if any.

The number of the prepreg sheets or plies is preferably 3 to 10, more preferably 3 to 8, still more preferably 3 to 5.

Figure 2:
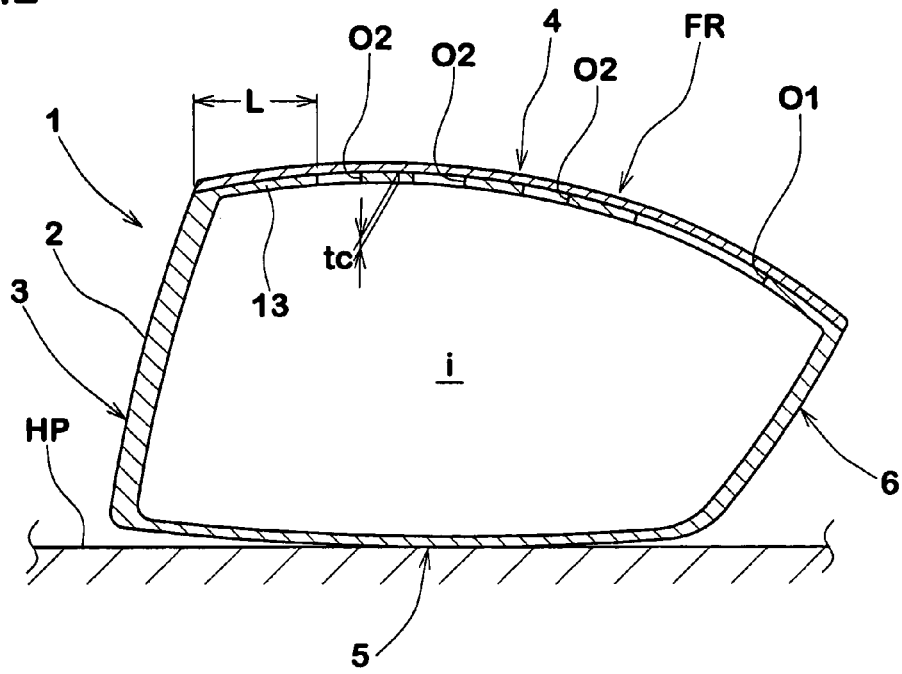
FIG. 2 is a cross sectional view thereof taken along line A-A of FIG. 1.
Figure 9:
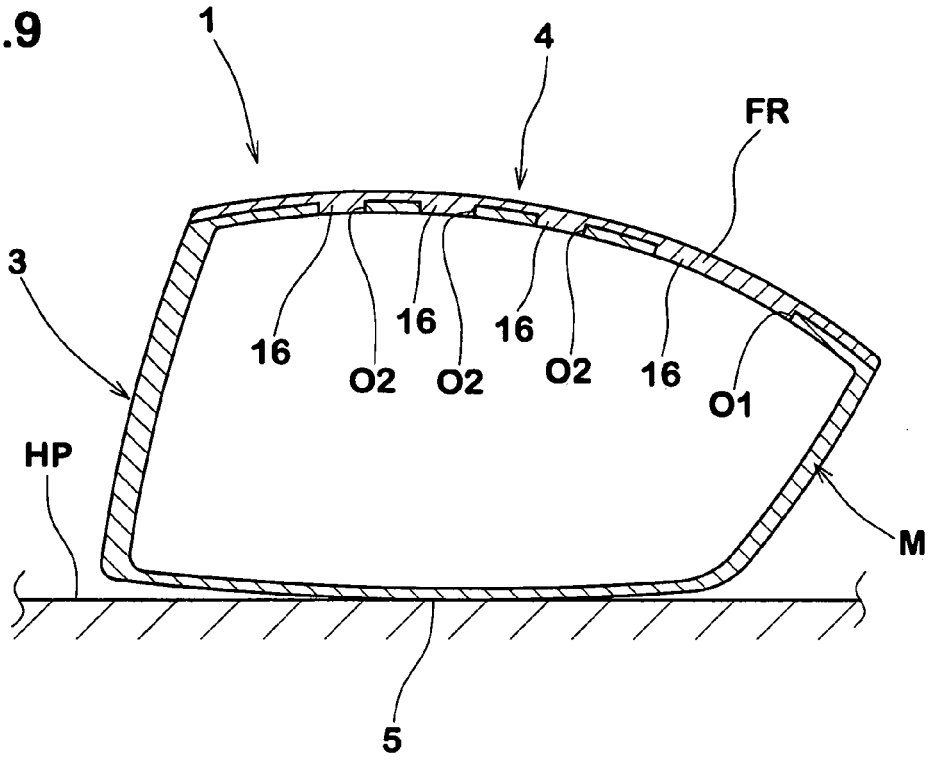
FIGS. 9 and 10 are cross sectional views similar to FIG. 2 each showing another example of the crown cover.

FIG. 9 shows a modification of the head shown in FIG. 2, wherein in order to improve the strength and durability, the crown cover FR is provided on the inner surface with protrusions 16 tightly coupled with the first opening O1 and second openings O2. The protrusions 16 are made from the same material (resin) as the crown cover FR.

Figure 10:
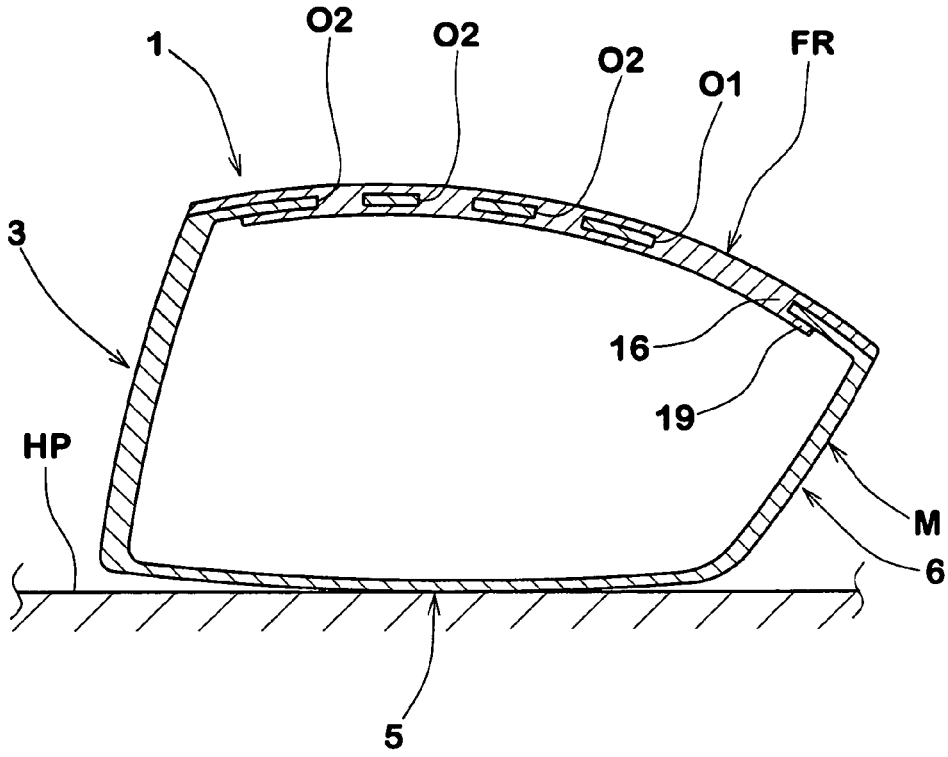

FIG. 10 shows another embodiment of the present invention, wherein the crown cover FR is further modified from that shown in FIG. 9 such that the crown base 10 is sandwiched between the crown cover FR and an additional inner anchor portion 19 which are jointed by the protrusions 16 through the openings O1 and O2. The additional inner anchor portion 19 and protrusions 16 are made from the same material as the crown cover FR.

Therefore, when a ball hits the face portion, as the crown portion is convexly curved as shown in FIG. 3, a tensile stress occurs on the outer crown cover FR, and a compressive stress occurs on the inner crown base 10. As the metal material of the crown base 10 is compressive resistant, owing to the tensile elastic deformation of the fiber reinforcing resin, the resilience of the crown portion is optimized to improve the rebound performance.

As the crown portion includes the crown base made of a metal material and the resin material forms a part of the crown portion, the energy loss of the impact force is decreased. Accordingly, the reverberating time and the frequency of the hitting sound are increased. Therefore, not only the rebound performance but also the hitting sound can be improved.

If the number of the second openings O2 is more than 20 and/or the opening area S2 is more than 2.0 sq. cm, then it becomes difficult to decrease the energy loss.

If the number of the second openings O2 is less than 10 and/or the opening area S2 is less than 0.5 sq. cm, then the improvement in the rebound performance and the weight reduction in the crown portion are hindered. Further, the frequency of the peak sound pressure of the hitting sound has a tendency to become excessively high for the majority.

If the ratio (S2*a*/S1) of the total area S2*a* of the second openings to the opening area S1 of the first opening O1 is more than 1.0, then the energy loss at impact tends to increase, and it becomes difficult to improve the rebound performance. If the ratio (S2*a*/S1) is less than 0.3, then the weight reduction in the crown portion is hindered, and there is a tendency for the hitting sound to become high.

Figure 11:
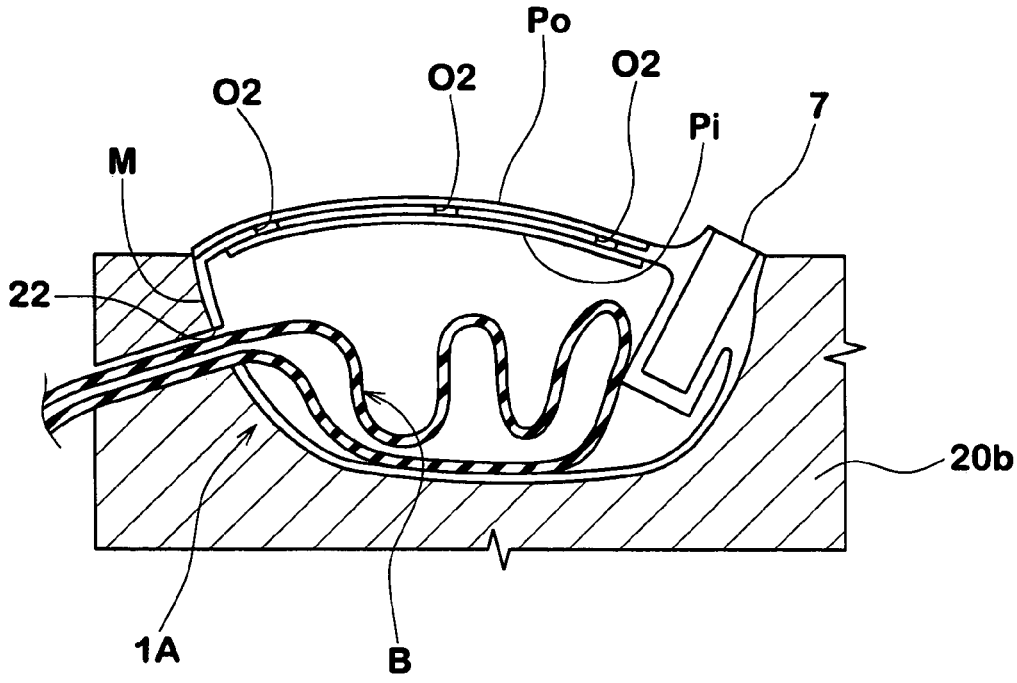
FIGS. 11 and 12 are cross sectional views for explaining a method of making the club head shown in FIG. 10.
Figure 12:
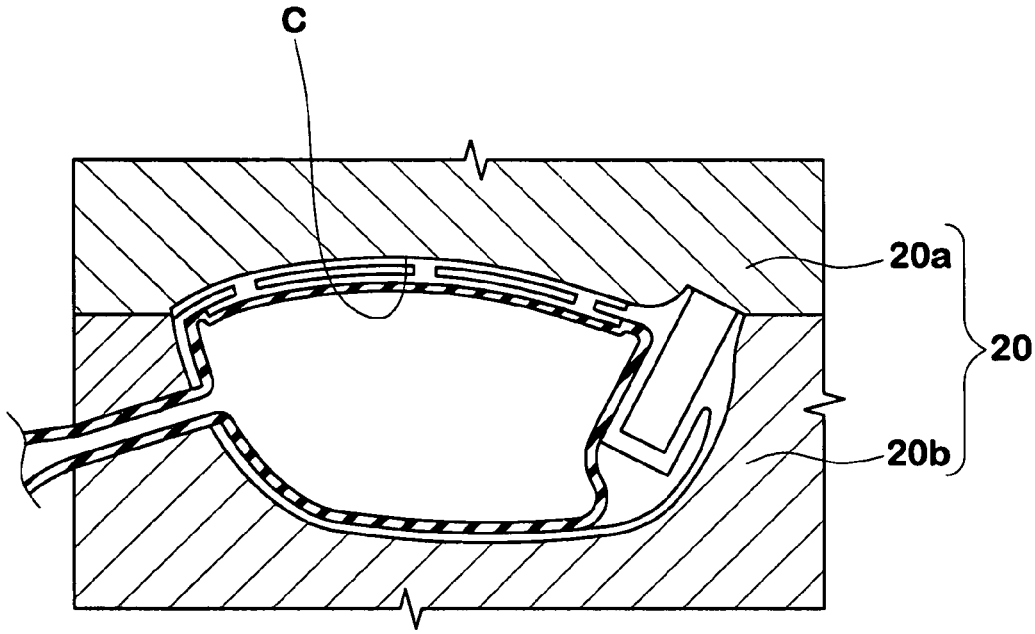

FIG. 11 and FIG. 12 show a method of making the crown cover FR with the anchor portion 19.

As shown in FIG. 11, inner prepreg sheets Pi and outer prepreg sheets Po are applied to the inside and outside of the crown base 10. The inner prepreg sheets Pi can be applied utilizing the first opening and/or additional opening formed in an appropriate portion for example the face portion or side portion. Before applying the prepreg sheets, heat-hardening adhesive agent, resin undercoating or the like may be applied to the crown base 10 and/or prepreg sheets to improve the adhesion therebetween. The assembly 1A of the main body and prepreg sheets is put in a mold 20 which comprises for example an upper die 20*a* and a lower die 20*b*. Incidentally, the prepreg sheets may be applied after setting the main body in the lower die 20*b* as a holder.

Then as shown in FIG. 12, a bladder B inserted in the main body is inflated with a high-pressure fluid which is injected utilizing an opening 22. And the mold 20 is heated to cure the prepreg. The opening 22 is formed in the side portion 6 in this example, but it may be formed in the sole portion or even in the bottom of the hosel. By the inflated bladder B, the outer prepreg sheets PO are pressed onto the inside of the upper die 20*a* and shaped. The inner prepreg sheets Pi are pressed onto the inside of the crown base 10 and also the outer prepreg sheets Po through the openings O1 and O2. As a result, the resin of the outer and inner prepreg sheets is fused and firmly jointed by hardening. After the cure, the bladder B is deflated and took out from the main body using the opening 22. The opening 22 is closed with a cover. The caver may be a brand name plate, ornamental badge or the like.

Comparison Tests

Figure 14:
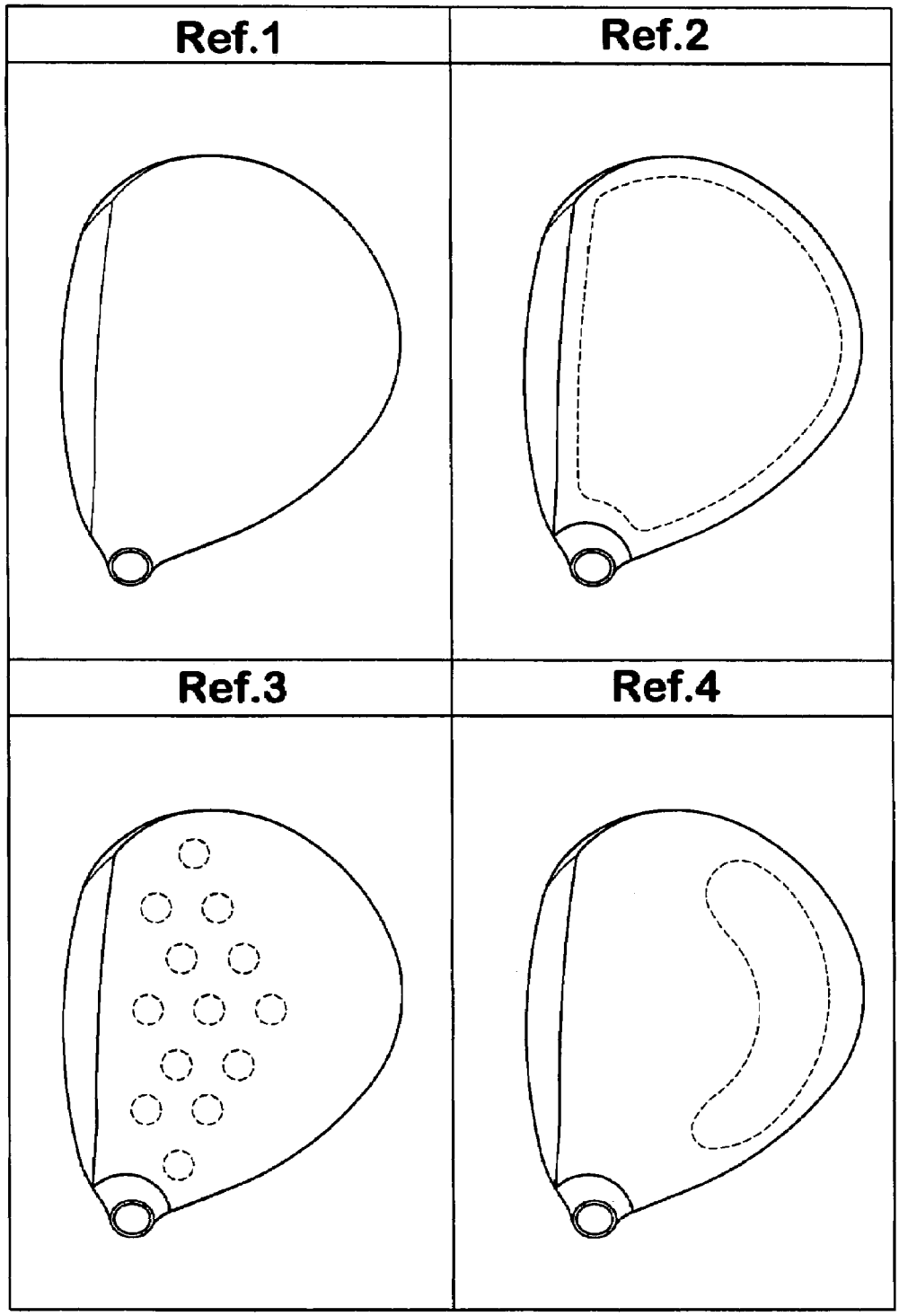
FIG. 14 is a table showing club heads used as Ref. 1-Ref. 4 in the undermentioned comparison tests.

Wood-type heads (head volume 420 cc, loft angle 11 degrees, lie angle 57 degrees) having the specifications shown in Table 1 and FIG. 14 were made, and tested for the restitution coefficient, durability and hitting sound.

In all the heads, the main body was a casting of a titanium alloy Ti-6Al-4V, and the crown cover was made from carbon fiber prepreg ("MR350C-050S", Mitsubishi Rayon Co., Ltd.) made from epoxide resin (resin content: 25%), and carbon fibers (tensile elastic modulus:294 GPa, fiber areal weight "FAW": 58 g/sq.m). The four-layered structure of the prepreg was put in a mold and cured into a specified shape of the crown cover as shown in FIG. 3. The thickness of the crown cover (plate) was 0.8 mm. The crown cover (plate) was fixed to the main body by the use of an adhesive agent ("EW2214", Sumitomo 3M Ltd.)

Restitution Coefficient Test:

According to the "Procedure for Measuring the velocity Ratio of a Club Head for conformance to Rule 4-1e, Appendix II, Revision 2 (Feb. 8, 1999), United States Golf Association", the restitution coefficient (e) of each club head was obtained. The results are shown in Table 1. The larger the value, the better the rebound performance.

Durability Test:

The club head was attached to an identical FRP shaft (MP200, SRI sports Ltd) to make a 45-inch wood-type golf club. The club was attached to a swing robot and hit two-piece balls at a head speed of 51 m/s 5000 times at the maximum until the club head was broken and the number of hits was counted.

Hitting Sound Test:

The sound generated at the time of hitting a two-piece ball was measured, and wave analysis up to 12,800 Hz was carried out to find out a frequency at which the reverberation time became longest.

The microphone position was 1 meter sideways from and 1.5 meter above the tee. If this frequency becomes higher than 4000 HZ, many golfers rank the hit sound as good sound. The results are shown in Table 1.

Moment of Inertia:

The moment of inertia around the vertical axis passing through the center of gravity of the club head was measured with a moment of inertia measuring instrument "MODEL No.005-002" manufactured by INERTIA DYNAMICS Inc.

TABLE 1

| Club Head | Ref. 1 | Ref. 2 | Ref. 3 | Ref. 4 | Ex. 1 | Ex. 2 | Ex. 3 | Ex. 4 | Ex. 5 |
|---|---|---|---|---|---|---|---|---|---|
| Crown cover | non | *1 | FIG. 3 | FIG. 3 | FIG. 3 | FIG. 3 | FIG. 3 | FIG. 3 | FIG. 3 |
| Opening arrangement | FIG. 14 | FIG. 14 | FIG. 14 | FIG. 14 | FIG. 4 | FIG. 8 | FIG. 4 | FIG. 4 | FIG. 4 |
| First opening | | | | | | | | | |
| Number | 0 | 1 | 0 | 1 | 1 | 1 | 1 | 1 | 1 |
| Shape | — | D-shape | — | C-shape | C-shape | C-shape | C-shape | C-shape | C-shape |
| Opening area S1 (sq · cm) | — | 24 | — | 24 | 24 | 24 | 24 | 24 | 24 |
| Second opening | | | | | | | | | |
| Number | 0 | 0 | 13 | 0 | 13 | 13 | 13 | 13 | 13 |
| Shape | — | — | circle | — | circle | hexagon | circle | circle | circle |
| Opening area S2 (sq · cm) | — | — | 1 | — | 1 | 1 | 1 | 1.8 | 1.5 |
| Total area S2a (sq · cm) | — | — | 13 | — | 13 | 13 | 13 | 23.4 | 19.5 |
| S2a/S1 | — | 0 | — | 0 | 0.54 | 0.54 | 0.54 | 0.98 | 0.67 |
| Minimum distance (mm) | | | | | | | | | |
| between first and second openings | — | — | — | — | 7 | — | 8.5 | 8.5 | 8.5 |
| between second openings | — | — | 7 | — | 7 | — | 10 | 0.3 | 0.9 |
| Non-opening zone depth L (mm) | — | — | 13 | — | 13 | 13 | 3 | 13 | 13 |
| Sweet spot height (mm) | 35.5 | 33 | 34.4 | 34.2 | 33.5 | 33.5 | 33.5 | 31.9 | 32.5 |
| Moment of inertia (g sq · cm) | 3600 | 4000 | 3650 | 3680 | 3820 | 3820 | 3820 | 3950 | 3900 |
| Restitution coefficient | 0.855 | 0.84 | 0.853 | 0.853 | 0.853 | 0.853 | 0.853 | 0.849 | 0.851 |
| Durability | 5000 | 3750 | 4900 | 4950 | 4950 | 4950 | 3800 | 3700 | 3900 |
| Hitting sound (Hz) | 6000 | 1200 | 5650 | 5600 | 5500 | 5500 | 5500 | 5200 | 5300 |

*1) crown plate like a crown cover shown in FIG. 3
Specific gravity: Main body = 4.4,
Crown cover (plate) = 1.4

From the test results, it was confirmed that the restitution coefficient and hitting sound can be improved while maintaining the center of gravity at a low position.

In the above embodiments, the crown cover FR exists only in the crown portion. But, it is also possible that the crown cover FR extends into the side portion.

Further, the above-mentioned crown cover FR is a single part. But, it may be made up of two or more separate parts.

The present invention is suitably applied to wood-type hollow heads. However, it is also possible to apply the invention to other types of heads such as iron-type and utility-type as far as they have a hollow structure.

The invention claimed is:

1. A golf club head comprising a main body and a crown cover disposed in a crown portion of the head, said main body comprising a crown base made of a metal material and provided with a plurality of openings, said openings gradually decreasing in the opening area from the backside to the foreside of the head, and said crown cover made of a material whose specific gravity is lower than said metal material, and disposed on the crown base so as to cover said openings, wherein said openings are a single first opening formed in the rear of the crown base, and a plurality of second openings smaller than the first opening and formed on the front side of the first opening, the second openings each have an area of from 0.5 to 2.0 sq.cm, the number of the second openings is in a range of from 10 to 20, the first opening has an area of from 20 to 30 sq.cm, and the centroid of the first opening is positioned on the backside of a position which is at a distance of 66% of the depth (CL) of the crown portion backwardly from the front end of the crown portion.

2. The golf club head according to claim 1, wherein the second openings have substantially same opening areas.

3. The golf club head according to claim 1, wherein the second openings are the substantially same shapes having substantially same opening areas.

4. The golf club head according to claim 2 or 3, wherein the total area S2*a* of the second openings is in a range of from 0.3 to 1.0 times the area S1 of the flrst opening.

5. A golf club head comprising a main body and a crown cover disposed in a crown portion of the head, said main body comprising a crown base made of a metal material and provided with a plurality of openings, said openings gradually decreasing in the opening area from the backside to the foreside of the head, and said crown cover made of a material whose specific gravity is lower than said metal material, and disposed on the crown base so as to cover said openings, wherein said openings are a single first opening formed in the rear of the crown base, and a plurality of second openings smaller than the first opening and formed on the front side of the first opening, the number of the second openings is in a range of from 10 to 20, the second openings each have an area of from 0.5 to 2.0 sq.cm, the first opening has an area of from 20 to 30 sq.cm, and the first opening is elongated in a toe-heel direction of the head and curved backward of the head so that the first opening has a front edge and a rear edge which are curved backward of the head, and the second openings are positioned on the front side of said front edge.

6. The golf club head according to claim 5, wherein the total area S2*a* of the second openings is in a range of from 0.3 to 1.0 times the area S1 of the first opening.

7. The golf club head according to claim 5, wherein the second openings have substantially same opening areas.

8. The golf club head according to claim 5, wherein the second openings are the substantially same shapes having substantially same opening areas.

9. The golf club head according to claim 1 or 5, wherein a front end zone of the crown portion defined as having a depth of from 8 to 25 mm is not provided with any opening.

10. The golf club head according to claim 1 or 5, wherein the second openings are arranged in a plurality of rows each extending in the toe-and-heel direction, and the number of the opening or openings in each of the rows is increased from the backside to the foreside of the head, and then decreased.

11. The golf club head according to claim 10, wherein said number is 1, 2, 3, 4 and 3, respectively, from the backside to the foreside of the head.

* * * * *